US011590670B2

(12) United States Patent
Kruger et al.

(10) Patent No.: US 11,590,670 B2
(45) Date of Patent: Feb. 28, 2023

(54) METHODS AND APPARATUS TO ALIGN APPLIQUE CUTTERS

(71) Applicant: The Boeing Company, Chicago, IL (US)

(72) Inventors: Kenneth A. Kruger, Bonney Lake, WA (US); George Michael Granger, Redmond, WA (US); Melissa H. Lewis, Auburn, WA (US); Nathan Owen Packard, Lake Stevens, WA (US); Alan G. Burg, Des Moines, WA (US); Brian D. Osborne, Seattle, WA (US)

(73) Assignee: The Boeing Company, Arlington, VA (US)

( * ) Notice: Subject to any disclaimer, the term of this patent is extended or adjusted under 35 U.S.C. 154(b) by 0 days.

(21) Appl. No.: 16/428,405

(22) Filed: May 31, 2019

(65) Prior Publication Data

US 2020/0376701 A1 Dec. 3, 2020

(51) Int. Cl.

| | |
|---|---|
| ***B26D 7/00*** | (2006.01) |
| ***B26D 5/10*** | (2006.01) |
| ***B26D 7/26*** | (2006.01) |

(52) U.S. Cl.

CPC ..... *B26D 7/0006* (2013.01); *B26D 5/10* (2013.01); *B26D 7/265* (2013.01)

(58) Field of Classification Search

CPC ... Y10T 83/667; Y10T 83/68; Y10T 83/8822; B26D 7/0006; B26D 5/10; B26D 7/265;

(Continued)

(56) References Cited

U.S. PATENT DOCUMENTS 1,202,435 A 10/1916 Scardino
2,520,000 A * 8/1950 Dettman ..... B26D 3/30 83/879

(Continued)

FOREIGN PATENT DOCUMENTS

CN 101918182 A 12/2010
CN 107263562 A 10/2017

(Continued)

OTHER PUBLICATIONS

Manufacturing textured surfaces: State of art and recent developments, Coblas, 2014 (Year: 2014).*

(Continued)

*Primary Examiner* — Evan H MacFarlane
*Assistant Examiner* — Fernando A Ayala
(74) *Attorney, Agent, or Firm* — Hanley, Flight & Zimmerman, LLC

(57) ABSTRACT

Methods and apparatus to align applique cutters are disclosed. A disclosed example alignment rail is for use with cutting an applique relative to a surface of a vehicle. The example alignment rail includes a base to contact the surface. The example alignment rail also includes a body including a cross-sectional profile extending along a longitudinal axis of the alignment rail. The example alignment rail also includes a groove of the cross-sectional profile extending along the longitudinal axis, where the groove is to align movement of a cutting tool to cut the applique.

20 Claims, 7 Drawing Sheets

(58) Field of Classification Search
CPC ..... B65H 2301/51512; B65H 35/0086; B65H 35/0093; B23Q 9/0014; F16C 29/005; F16C 29/02
See application file for complete search history.

(56) References Cited

U.S. PATENT DOCUMENTS 3,896,554 A * 7/1975 Pacion ..... G01B 3/04 33/489
4,495,709 A * 1/1985 Mainenti ..... G01B 3/04 33/484
4,941,380 A * 7/1990 Lockwood ..... B23Q 1/26 83/454
5,269,212 A * 12/1993 Peters ..... B26D 1/045 83/578
5,271,305 A * 12/1993 Peters ..... B26D 1/045 33/32.1
5,404,778 A 4/1995 Ward
5,930,898 A * 8/1999 Lyon ..... F16C 29/005 29/451
6,305,093 B1 * 10/2001 Venola ..... A47G 1/205 33/451
8,096,058 B2 * 1/2012 Wood ..... G01B 3/04 33/483
8,715,824 B2 * 5/2014 Rawlings ..... B32B 15/08 428/337
9,592,622 B2 * 3/2017 Bagley ..... B26D 7/01
2002/0095804 A1 * 7/2002 Coplan ..... B25H 1/0078 33/484
2002/0166250 A1 * 11/2002 Jimenez ..... B43L 7/005 33/483
2003/0140761 A1 * 7/2003 Schulz ..... B23D 35/008 83/614
2003/0209879 A1 * 11/2003 Lindenman ..... B62D 53/0842 280/438.1
2005/0284278 A1 * 12/2005 Shimizu ..... B26D 7/0006 83/614
2006/0102682 A1 * 5/2006 Etter ..... B23B 49/00 227/2
2006/0150796 A1 * 7/2006 Tseng ..... B26D 1/045 83/745
2011/0209594 A1 * 9/2011 Withers ..... B65H 35/0086 83/614
2012/0234150 A1 * 9/2012 Holtgreive ..... B26F 1/3853 83/613
2013/0126574 A1 * 5/2013 Mallet ..... B28D 1/228 225/2
2014/0260849 A1 * 9/2014 Johnson ..... B23C 3/18 83/39
2016/0144522 A1 * 5/2016 Zhang ..... B26D 7/2628 83/564

FOREIGN PATENT DOCUMENTS

DE 202004014970 2/2006
EP 1279467 1/2003
EP 2412487 A2 2/2012
EP 2412487 A3 4/2015
FR 2329422 A1 5/1977
GB 2 416 302 A 1/2006

OTHER PUBLICATIONS

European Patent Office, "Extended European Search Report," issued in connection with European Patent Application No. 20177404.9, dated Oct. 21, 2020, 7 pages.
National Intellectual Property Administration, "Notification of the First Office Action," issued in connection with Chinese Application No. 2020104709506, dated Mar. 9, 2022, 19 pages (including English translation).
The State Intellectual Property Office of the People's Republic of China, "Notification of the Second Office Action," issued in connection with Chinese Application No. 2020104709506, dated Jul. 6, 2022, 11 pages (including English translation).

* cited by examiner

METHODS AND APPARATUS TO ALIGN APPLIQUE CUTTERS

FIELD OF THE DISCLOSURE

This patent relates generally to applique and, more particularly, to methods and apparatus to align applique cutters.

BACKGROUND

Applique can be applied to vehicles to define microstructures (e.g., riblets) (e.g., to alter aerodynamic characteristics) and/or alter an aesthetic appearance. The applique typically includes an adhesive to increase resiliency and/or increase the ability of the applique to adhere to a surface of a vehicle.

SUMMARY

An example alignment rail is for use with cutting applique relative to a surface of a vehicle. The example alignment rail includes a base to contact the surface, and a body including a cross-sectional profile extending along a longitudinal axis of the alignment rail. The example alignment rail also includes a groove of the cross-sectional profile extending along the longitudinal axis, where the groove is to align movement of a cutting tool to cut the applique.

An example method includes placing an alignment rail relative to an a surface of a vehicle and placing an applique over the alignment rail. The example method also includes aligning a first surface of a cutting tool to a second surface of the alignment rail, and cutting the applique by moving the cutting tool along a longitudinal length of the alignment rail, where the cutting tool is guided by the first surface contacting the second surface.

An example system for aligning and cutting applique to be applied to a surface of a vehicle includes an alignment rail having a groove extending along a longitudinal axis of the alignment rail, and a cutting tool having a portion to be aligned and received by the groove.

BRIEF DESCRIPTION OF THE DRAWINGS

Wherever possible, the same reference numbers will be used throughout the drawing(s) and accompanying written description to refer to the same or like parts.

DETAILED DESCRIPTION

Methods and apparatus to align applique cutters are disclosed herein. Microstructures such as riblets, for example, are typically applied to aerodynamic surfaces of an aircraft as an applique to reduce drag and/or a drag coefficient of the aircraft, which can result in overall fuel savings and/or a reduction in carbon-dioxide emissions, etc. Other applique are used for aesthetic purposes (e.g., to change or alter an appearance of the aircraft). Regardless of purpose, providing applique to a surface of an aircraft is often time-consuming and can necessitate multiple tools to ensure that the applique is properly aligned, cut, and secured to the surface of the aircraft.

Example methods and apparatus disclosed herein enable accurate and time-efficient alignment, cutting, and application of applique for use with any surface, such as an aerodynamic surface, for example. In particular, examples disclosed herein include an alignment rail to guide movement of a cutting tool to apply applique onto the surface. For example, the alignment rail includes a body and a base that contacts the surface. Further, the body includes a cross-sectional profile extending along a longitudinal axis of the alignment rail. The cross-sectional profile of the body includes a groove extending along the longitudinal axis. The groove is to align and/or position a cutting tool to guide the cutting tool during cutting of applique. As a result, the alignment rail enables the cutting tool to efficiently and accurately cut the applique without use of time-consuming and inaccurate manual alignment. Accordingly, examples disclosed herein enable dimensional control of overlap between adjacent applique pieces or of gaps between adjacent pieces of applique.

Examples disclosed herein enable parallel alignment of applique edges with uniform width on two-dimensional (2D) as well as three-dimensional (3D) contoured surfaces, thereby reducing (e.g., eliminating) "edge walk" from a straight line that can result when flat films are applied to long, curved surfaces, for example. Accordingly, maintaining edges parallel to a specified orientation can be important for some applications, such as riblet applique and aesthetic applique. Although examples disclosed herein are shown in the context of aircraft surfaces, example disclosed herein can be implemented on any appropriate 2D or 3D surface application where relatively parallel applique edges are desired.

As used herein, the term "ramped surface" refers to a surface that is ramped and/or inclined relative to a reference surface and/or a base. As used herein, the term "cutting tool" refers to a device, mechanism, assembly and/or system used to cut applique. Accordingly, the term "cutter" refers to a cutting component that directly contacts the applique. As used herein, the term "datum" refers to a fixed reference point for an alignment rail to be positioned. The datum may be predefined or based on a reference feature (e.g., a fixed component, etc.).

Figure 1:
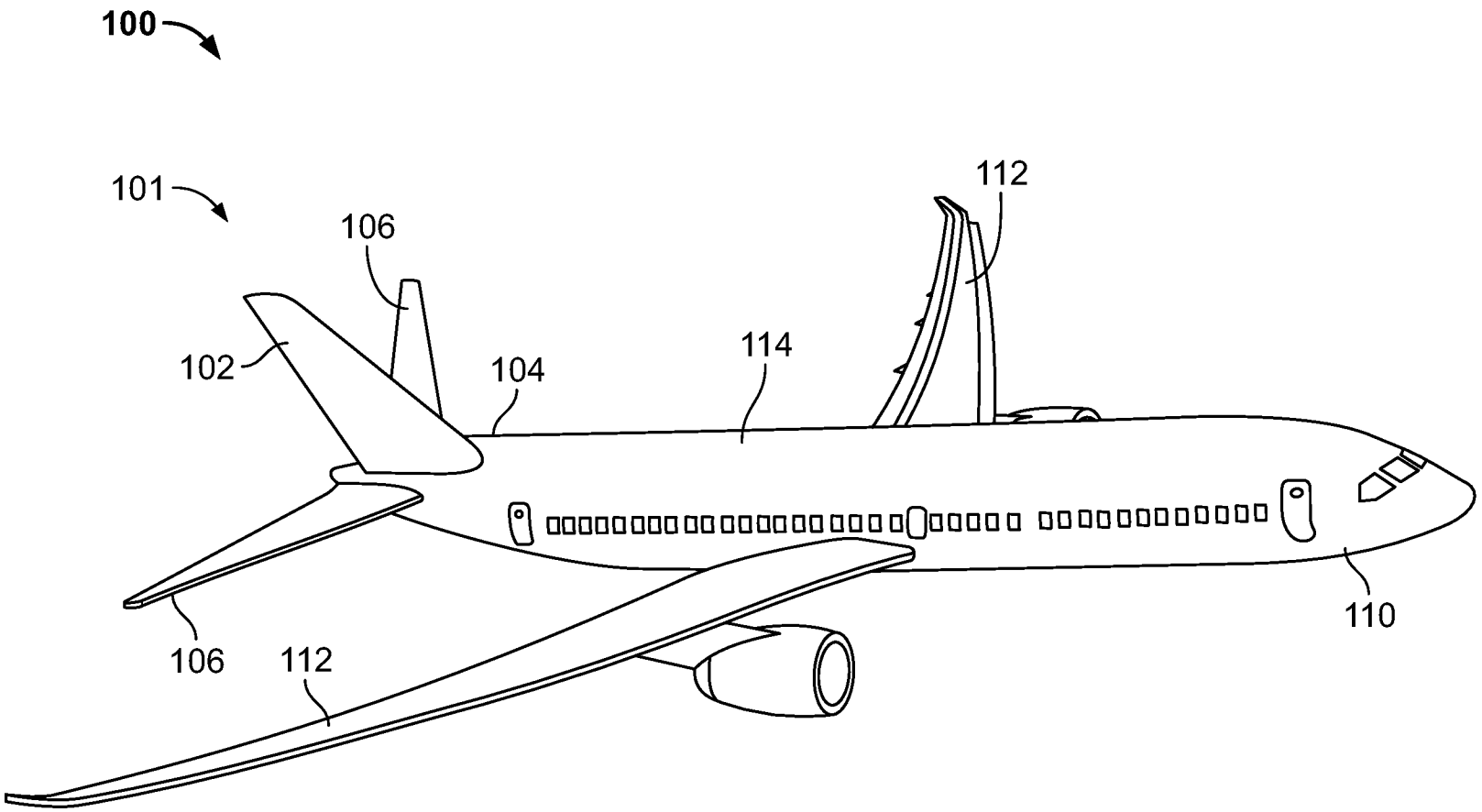
FIG. 1 illustrates an example aircraft that may be used to implement examples disclosed herein.

FIG. 1 illustrates an example aircraft 100 in which examples disclosed herein may be implemented. The aircraft 100 of the illustrated example includes a tail section 101 with a vertical fin 102 adjacent to a dorsal fairing 104, horizontal stabilizers 106, a nose section (e.g., a cockpit section) 110 and wings 112 attached to a fuselage 114. Examples disclosed herein may be utilized to align, cut, and apply applique to surfaces and/or features of any of the tail section 101, the nose section 110, the horizontal stabilizers 106, the wings 112 and/or the fuselage 114, or any other exterior or outboard structure (e.g., a wing strut, an engine strut, a canard stabilizer, etc.) and/or surface of the aircraft 100.

Figure 2A:
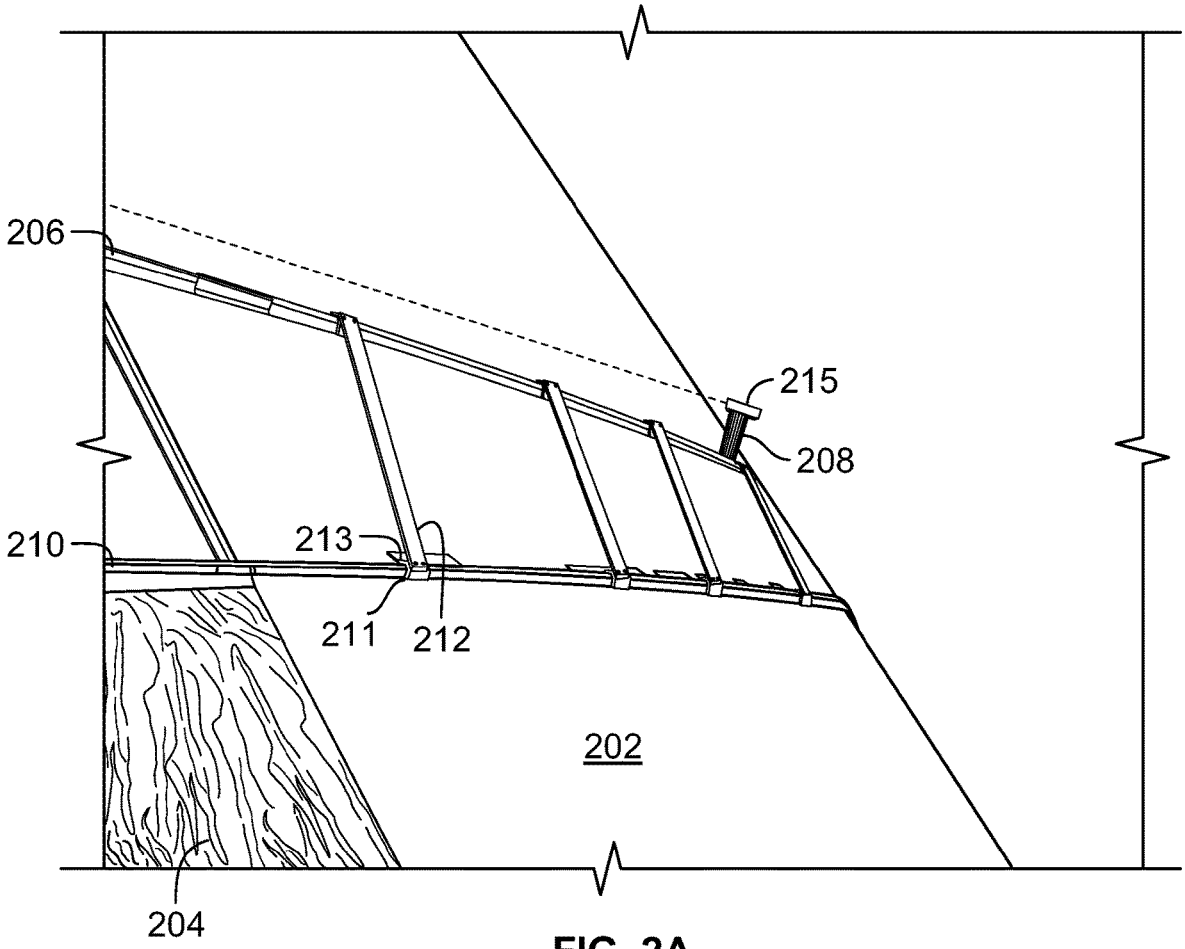
FIGS. 2A-2B illustrate guided positioning of an example alignment rail in accordance with teachings of this disclosure.
Figure 2B:
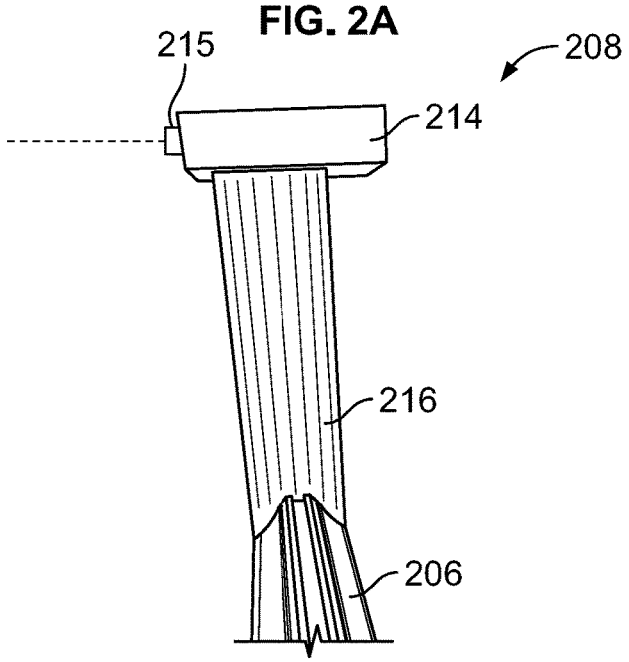

FIGS. 2A-2B illustrate positioning of an example alignment rail in accordance with teachings of this disclosure. As can be seen in FIG. 2A, an aerodynamic body (e.g., an aerodynamic surface) 202, which is one of the wings 112 in this example, is being covered with an applique 204. In this example, a first alignment rail 206 is shown aligned and positioned relative to the aerodynamic body 202. In particular, the first alignment rail 206 is positioned and aligned relative to the aerodynamic body 202 to guide movement of a cutting tool 500 shown and described below in connection with FIGS. 5A and 5B so that the applique 204 can be cut and adjoined to another applique and/or geometric features of the aircraft 100. In other words, the first alignment rail 206 is aligned relative to the aerodynamic body 202 to enable accurate cutting and placement of the applique 204. Further, a second alignment rail 210 is shown positioned relative to the first alignment rail 206.

To position the first alignment rail 206 onto or relative to the aerodynamic body 202, examples disclosed herein utilize a laser guide 208 that is positioned on or relative to a reference datum (e.g., a component of the fuselage 114). In this example, the laser guide 208 emits a laser toward the reference datum to indicate a desired position and/or orientation of the first alignment rail 206 relative to the aerodynamic body 202. For example, the laser guide 208 may emit a laser toward the datum while constraining at least a portion of the first alignment rail 206 to position the first alignment rail 206 relative to the aerodynamic body 202. In some other examples, the laser is emitted from a known datum reference of the aircraft 100 to the alignment rail or a target associated with the alignment rail to indicate a desired position and/or alignment of the first alignment rail 206. While the illustrated example of FIG. 2B depicts an offset from the fuselage 114 with the laser, any appropriate means of alignment can be implemented instead, such as a tape measure, etc.

To position the second alignment rail 210 relative to the first alignment rail 206, the second alignment rail 210 is positioned using example spacers 212, each of which include a v-shaped clamp portion 211 with corresponding ramped surfaces 213. In particular, the spacers 212 of the illustrated example are spaced apart and/or sized to define relative spacing (e.g., relative parallel spacing) between the second alignment rail 210 and the first alignment rail 206. Accordingly, once the first alignment rail 206 and the second alignment rail 210 are mounted to the aerodynamic body 202, the applique 204 is placed over the first alignment rail 206 and the second alignment rail 210 for cutting, as discussed in greater detail below in connection with FIGS. 3-4.

Turning to FIG. 2B, the example laser guide 208 is shown. The example laser guide 208 includes a laser mount 214 and a support post 216. The laser mount 214 houses and positions a laser 215. In the illustrated example, the support post 216 contacts and at least partially constrains the first alignment rail 206.

In operation, the laser guide 208 is positioned onto the aerodynamic body 202 based on the laser 215 emitting a laser toward a target (e.g., a datum target) and/or a datum (e.g., a fixed support, a portion of the aircraft 100, etc.) of the aircraft 100. Accordingly, the laser guide 208 is moved along with the first alignment rail 206 to ensure that the emitted laser is properly oriented, thereby aligning the first alignment rail 206 to the aerodynamic body 202. In other examples, a laser is emitted from a reference point (e.g., from the fuselage 114, from a datum of the fuselage 114) and the support post 216 or any structure coupled thereto is moved based on the emitted laser to position the first alignment rail 206. In some such examples, the laser can be emitted from the fuselage.

Figure 3:
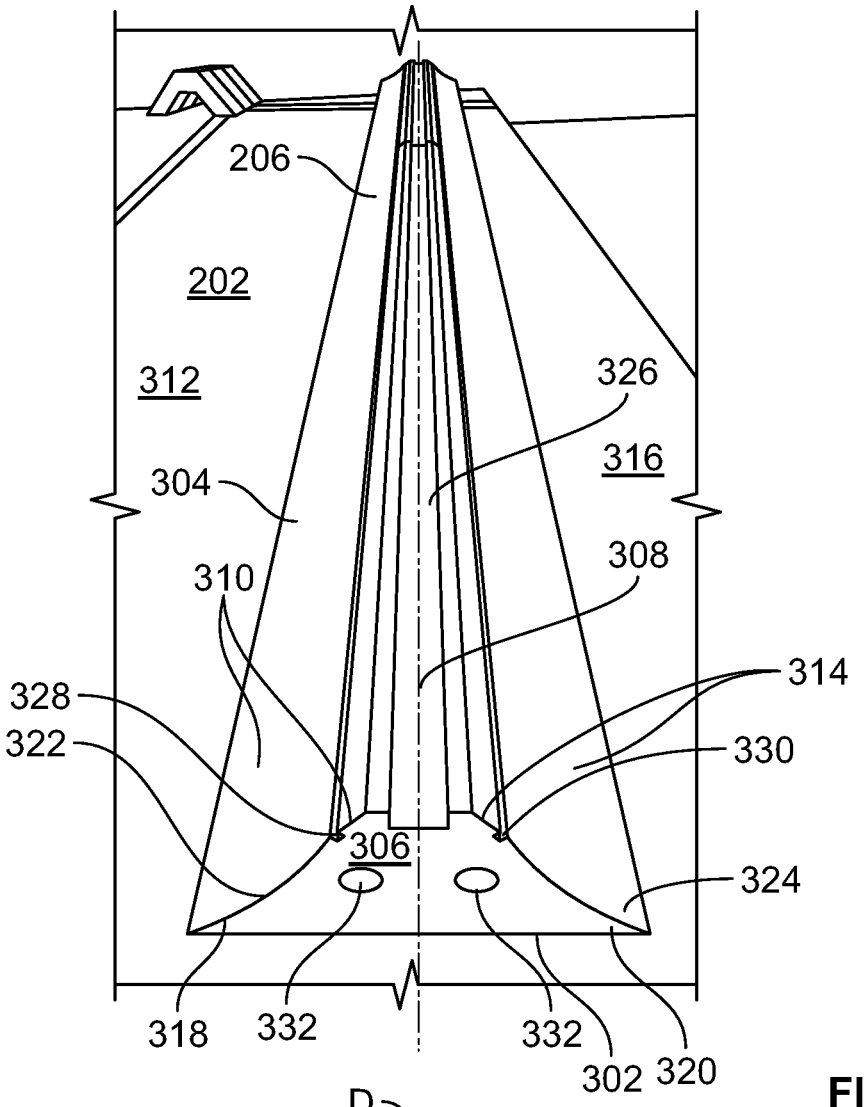
FIG. 3 illustrates the example alignment rail of FIGS. 2A-2B.

FIG. 3 illustrates the example alignment rail 206 of FIGS. 2A-2B. The first alignment rail 206 of the illustrated example includes a base (e.g., a base surface, a contact surface, etc.) 302, and a body 304 having a cross-sectional profile 306 extending along a longitudinal axis 308 of the first alignment rail 206. The cross-sectional profile 306 of the illustrated example defines a first ramped surface 310 on a first side 312 of the cross-sectional profile 306 and a second ramped surface 314 on a second side 316 of the cross-sectional profile 306 that is opposite the first side 312. In the illustrated example, the first ramped surface 310 is angled from the base 302 at a first angle 318, which varies along a direction away from the base 302 (i.e., a slope is varied along the direction away from the base 302). Similarly, the second ramped surface 314 is angled from the base 302 at a second angle 320 that also varies along the direction away from the base 302. In this example, the first angle 318 and the second angle 320 are identical. However, in other examples, they may be different.

In some examples, the first ramped surface 310 includes a first concave surface 322 and, similarly, the second ramped surface 314 includes a second concave surface 324. Further, the first ramped surface 310 and the second ramped surface 314 of the illustrated example converge toward a groove (e.g., a center groove) 326, which extends along the longitudinal axis 308. In the illustrated example, the first ramped surface 310 of the illustrated example includes a corresponding first groove 328, and the second ramped surface 314 includes a second corresponding groove 330. In some examples, the first alignment rail 206 includes alignment holes 332 to receive a portion (e.g., a protrusion) of another alignment rail to extend an effective length thereof.

To bring the first alignment rail 206 in contact with a surface of the aerodynamic body 202, the base 302 is placed onto the aerodynamic body 202 with the groove 326 facing upward (in the view of FIG. 2). In some examples, the base 302 is coupled and/or adhered to the aerodynamic body 202. For example, the base 302 includes a textured surface, suction cups, and/or flaps to couple the first alignment rail 206 to the aerodynamic body 202.

Figure 5A:
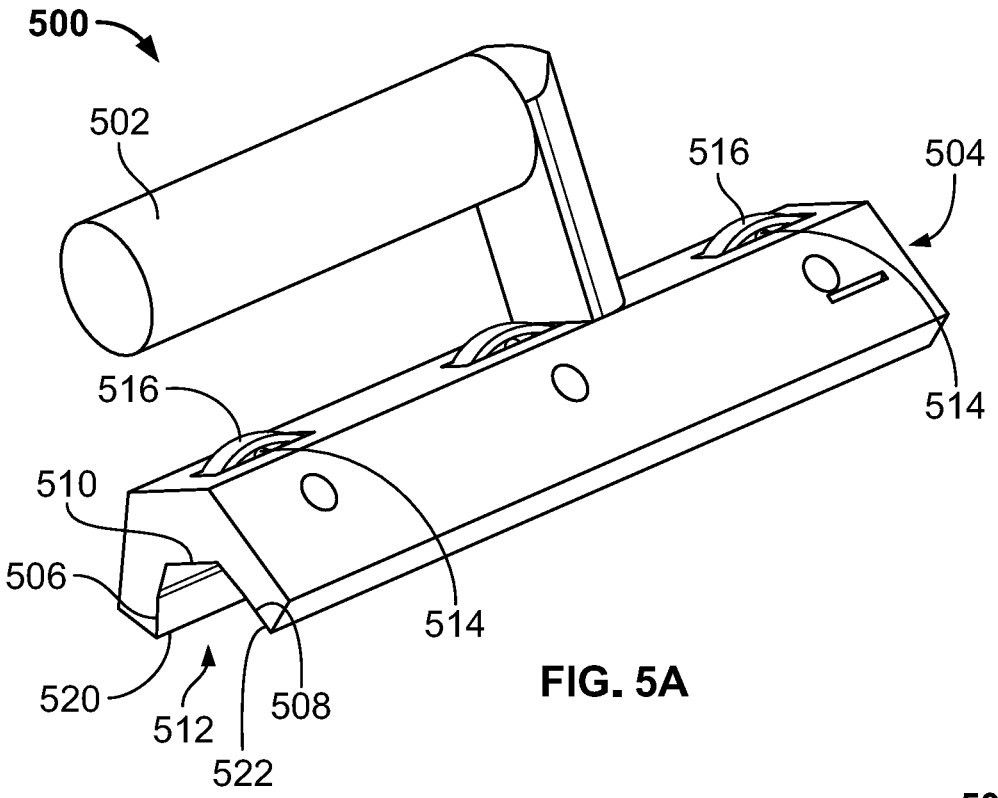
FIGS. 5A-5B illustrate an example cutting tool that can be used in conjunction with the example alignment rail of FIGS. 2A-4 to cut applique.
Figure 5B:
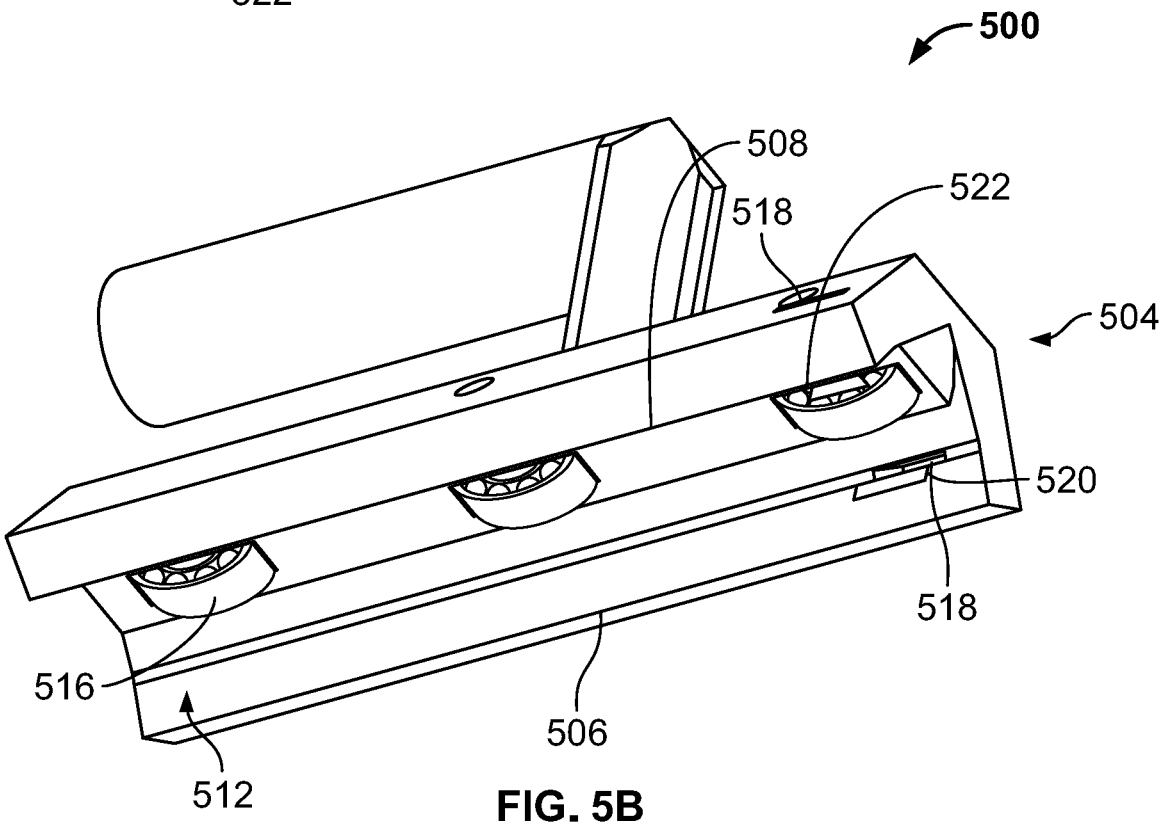

To align movement of the aforementioned cutting tool 500 when cutting applique, the example groove 326 receives at least a portion of the cutting tool 500 of FIGS. 5A-5B to cut the applique 204. In this example, the first groove 328 and the second groove 330 are to receive portions (e.g., blade tips) of the cutting tool 500 during cutting of the applique 204 when the applique 204 is positioned over at least one of the first ramped surface 310 or the second ramped surface 314.

To space the first alignment rail 206 to the second alignment rail 210, the spacers 212 shown in FIG. 2 include the aforementioned ramped surfaces 213 to receive the ramped surfaces 310, 314. In other words, the spacers 212 of the illustrated example are able to space the first alignment rail 206 to the second alignment rail 210, as well as maintain a relative orientation therebetween (e.g., maintain the first alignment rail 206 to be parallel with the second alignment rail 210).

In some examples, the first alignment rail 206 is manufactured via additive manufacturing (e.g., 3D Metal Printing, 3D Wax Printing, 3D Binder Jet Sand Mold Printing, etc.) to form a structure with a varied internal cross section spanning a solid fill. In some examples, the holes 332 can be used to anchor pins to cellular structures to reduce weight or stiffness of a corresponding structure. In some examples, the first alignment rail 206 is manufactured from synthetic polymers and/or 3D printing filaments such as, nylon, polyethylene resin, Armadillo™, foam, etc.

Figure 4:
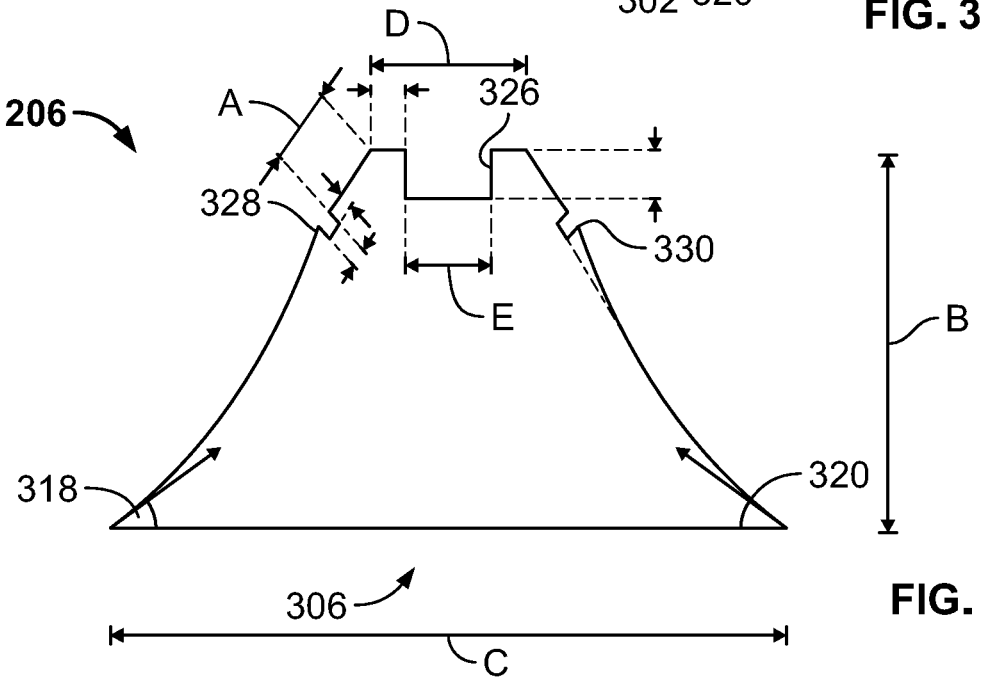
FIG. 4 is a cross-sectional view of the example alignment rail of FIGS. 2A-3.

FIG. 4 is a cross-sectional view of the example alignment rail 206 of FIGS. 2A-3. In particular, FIG. 4 depicts the cross-sectional profile 306 of the example alignment rail 206. In some examples, the first ramped surface 310 and/or the second ramped surface 314 are textured to prevent unintended adhesion between the first alignment rail 206 and the applique 204. In some examples, the first angle 318 and/or the second angle 320 are approximately 25-35 degrees. In some examples, relative placement of the first groove 328 and/or the second groove 330 is defined by a first ratio of a distance from a top surface (in the orientation of FIG. 4) to the overall height, as depicted by AB of FIG. 4. The first ratio can be approximately equal to 0.04 to 0.14 (e.g., 0.09), for example. Further, in some examples, a ratio of a top width of the first alignment rail 206 to an overall width of the first alignment rail 206, as depicted by D/C of FIG. 4, is equal to approximately 0.17 to 0.29 (e.g., 0.23). In some examples, a ratio of a width of the groove 326 to the overall width of the first alignment rail 206 is a ratio, as depicted by E/C of FIG. 4, with a value of approximately 0.11 to 0.15 (e.g., 0.13). The aforementioned example ratios can facilitate bending of the applique 204 without impairing cutting accuracy, for example. However, any appropriate ratio can be applied instead. The above-described example ratios can enable control of applique overlap at edges from positive values to negative values (i.e. gaps).

FIGS. 5A-5B illustrate the aforementioned example cutting tool 500 that can be implemented with the example alignment rail 206 of FIGS. 2A-4 to cut the applique 204. The cutting tool 500 of the illustrated example includes a handle 502 and a body (e.g., a cutter section) 504. The body 504 of the example cutting tool 500 includes a first ramped surface 506, and a second ramped surface 508 that opposedly faces the first ramped surface 506, for example. Accordingly, the first ramped surface 506 and the second ramped surface 508 converge toward a guide surface 510 to define a channel 512. As illustrated in FIG. 5B, the body 504 includes openings 514 to receive and mount ball bearings 516.

Turning to FIG. 5B, the cutting tool 500 is shown from a different perspective from that of FIG. 5A. In the illustrated example, the body 504 includes openings 518 to mount and align a first cutter (e.g., a cutting blade, a cutting implement, etc.) 520 on the first ramped surface 506. Similarly, the openings 518 also mount and align a second cutter 522 on the second ramped surface 508.

In operation, the channel 512 of the illustrated example is to receive a portion of the first alignment rail 206. In particular, the first ramped surface 310 of the first alignment rail 206 is to contact the first ramped surface 506 of the cutting tool 500, and the second ramped surface 314 of the first alignment rail 206 is to contact the second ramped surface 508 of the cutting tool 500, thereby laterally constraining the cutting tool 500 to the first alignment rail 206.

To facilitate movement of the cutting tool 500 along the length of the first alignment rail 206, the ball bearings 516 are received by the groove 326 of the first alignment rail 206. As a result, the cutting tool 500 moves longitudinally along the first alignment rail 206 as the ball bearings contact the groove 326 and rotate as the cutting tool 500 is moved along the first alignment rail 206.

To cut the applique 204 during motion of the cutting tool 500, the cutting tool 500 includes the first cutter 520 (e.g., a blade) on the first ramped surface 506, and the second cutter 522 on the second ramped surface 508. In some examples, the cutting tool 500 only includes one of the first cutter 520 or the second cutter 522. In this example, the first cutter 520 is received by the first groove 328 of the first alignment rail 206 and, likewise, the second cutter 522 is received by the second groove 330 of the first alignment rail 206 to cut the applique 204 when the applique 204 is positioned over the first ramped surface 310 and the second ramped surface 314.

Figure 6:
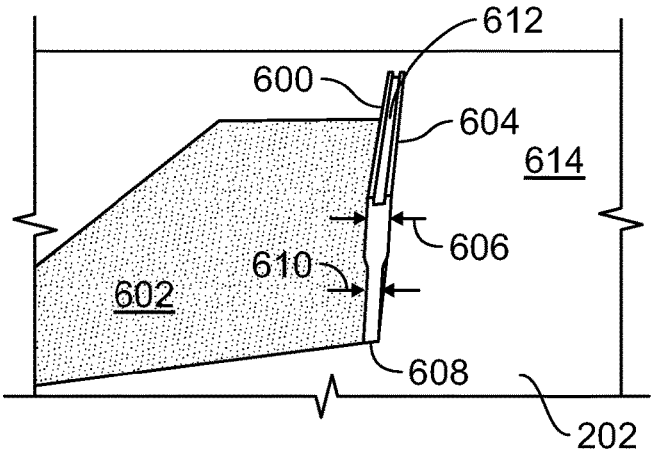
FIG. 6 illustrates another example alignment rail for aligning and cutting applique.

FIG. 6 illustrates another example alignment rail 600 to align and cut the applique 204. In the illustrated example of FIG. 6, the alignment rail 600 is coupled to the aerodynamic body 202 via a mount 602, which may be implemented as a bracket (e.g., an l-shaped bracket) and/or an adhesive. The alignment rail 600 of the illustrated example includes a first end (e.g., a distal end) 604 having a respective first thickness 606. The alignment rail 600 also includes a second end 608 (e.g., a proximate end) opposite the first end 604 with a respective second thickness 610 smaller than the first thickness 606. In some examples, the alignment rail 600 includes a groove 612 that extends along a longitudinal length of the alignment rail 600 to guide movement of a cutting tool 700 of FIG. 7.

Figure 7:
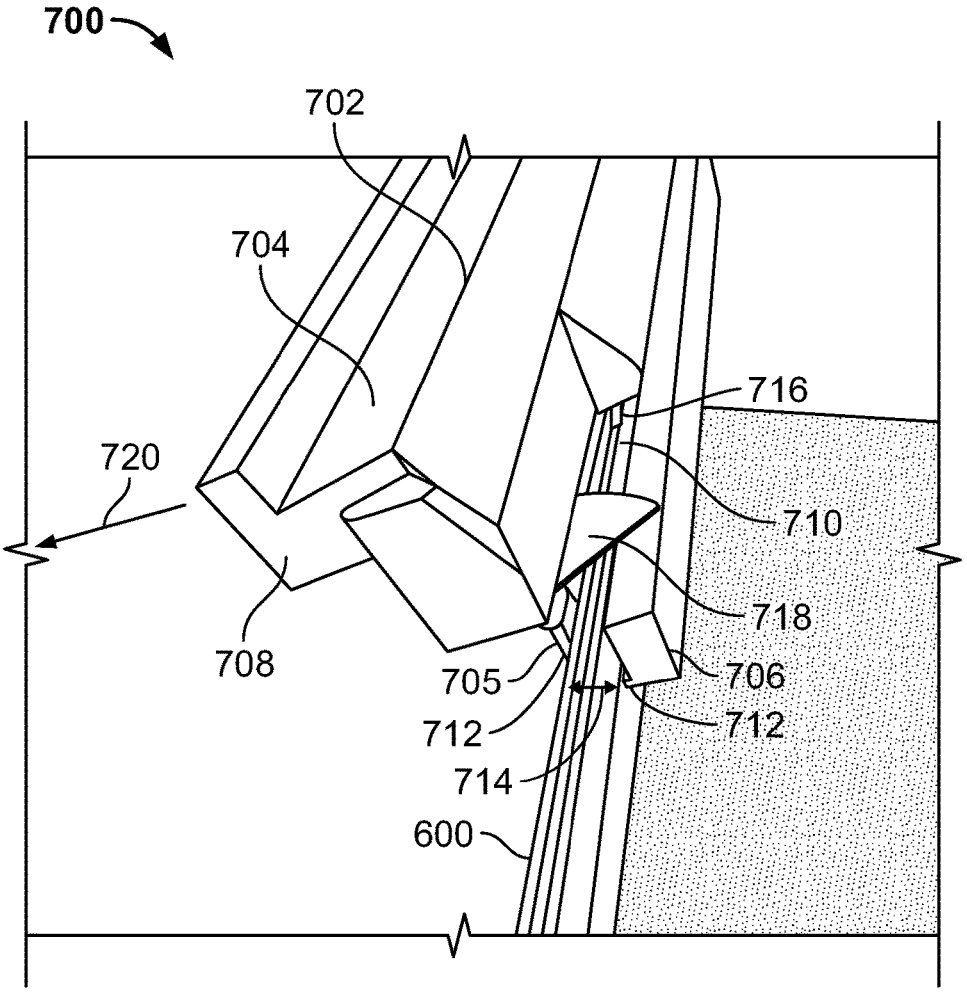
FIGS. 7-8B illustrate an example cutting tool that can be used in conjunction with example alignment rail of FIG. 6.

FIG. 7 illustrates the aforementioned example cutting tool 700 being used in conjunction with the example alignment rail 600 of FIG. 6. The cutting tool 700 of the illustrated example includes a body 702 having a wall 704 and guides 705, 706. The wall 704 of the illustrated example includes a flange 708 that extends perpendicularly from the body 702. In the illustrated example, the guides 705, 706 at least partially define a channel 710. Further, the example guides 705, 706 include respective protrusions 712 that longitudinally extend along the channel 710 to define a gap 714 therebetween. The channel 710 of the illustrated example includes a protrusion (e.g., a post) 716. In this example, the cutting tool 700 of the illustrated example includes a cutter 718 (e.g., a blade).

To place the cutting tool 700 onto the alignment rail 600, the channel 710 is brought into contact with the first end 604 of the alignment rail 600 and the protrusions 712 of the guides 705, 706 constrain the cutting tool 700 relative to the alignment rail 600 due to a relative sizing of the protrusions 712 and the gap 714. Additionally or alternatively, the protrusion 716 is received by the groove 612 to maintain alignment of the cutting tool 700 relative to the alignment rail 600.

In some examples, the applique 204 is positioned on a first side 614 of the alignment rail 600 and the alignment rail 600 is pivoted along a direction generally indicated by an arrow 720 as the example cutting tool 700 and the cutter 718 are slid along the alignment rail 600. In some examples, the cutter 718 is spring-loaded.

Figure 8A:
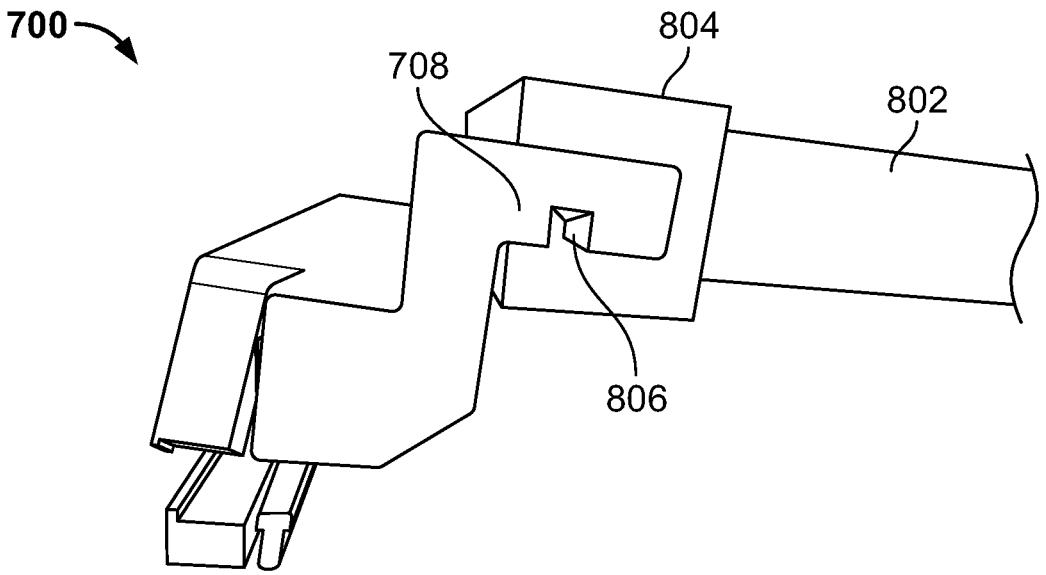
Figure 8B:
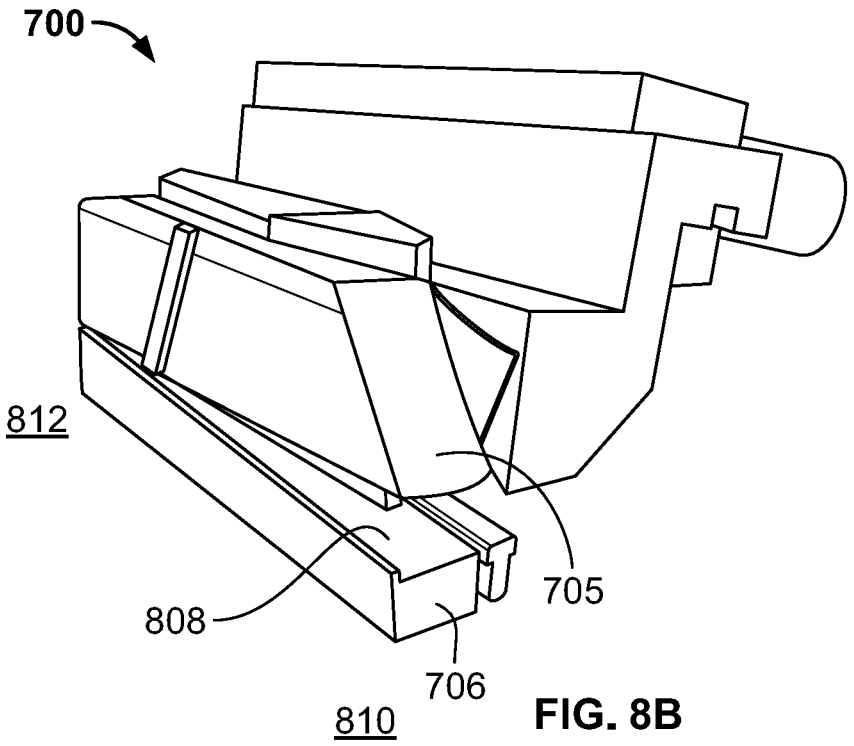

FIGS. 8A-8B illustrate the example cutting tool 700 disengaged from the alignment rail 600. Turning to FIG. 8A, the cutting tool 700 is shown including a handle (e.g., a removable handle) 802. The handle 802 of the illustrated example includes a locking mechanism 804 that receives the flange 708 via a locking channel 806.

FIG. 8B depicts a perspective view of the cutting tool 700. In the illustrated example of FIG. 8B, the guides 705, 706 define a receiving portion 808. In particular, the guides 705, 706 are spaced apart a first distance at a first end 810 of the cutting tool 700, and spaced apart a second distance that is smaller than the first distance at a second end 812 of the cutting tool 700. Accordingly, the cutting tool 700 has a lead-in area at the first end 810 to facilitate the alignment rail 600 being received by the receiving portion 808.

Figure 9:
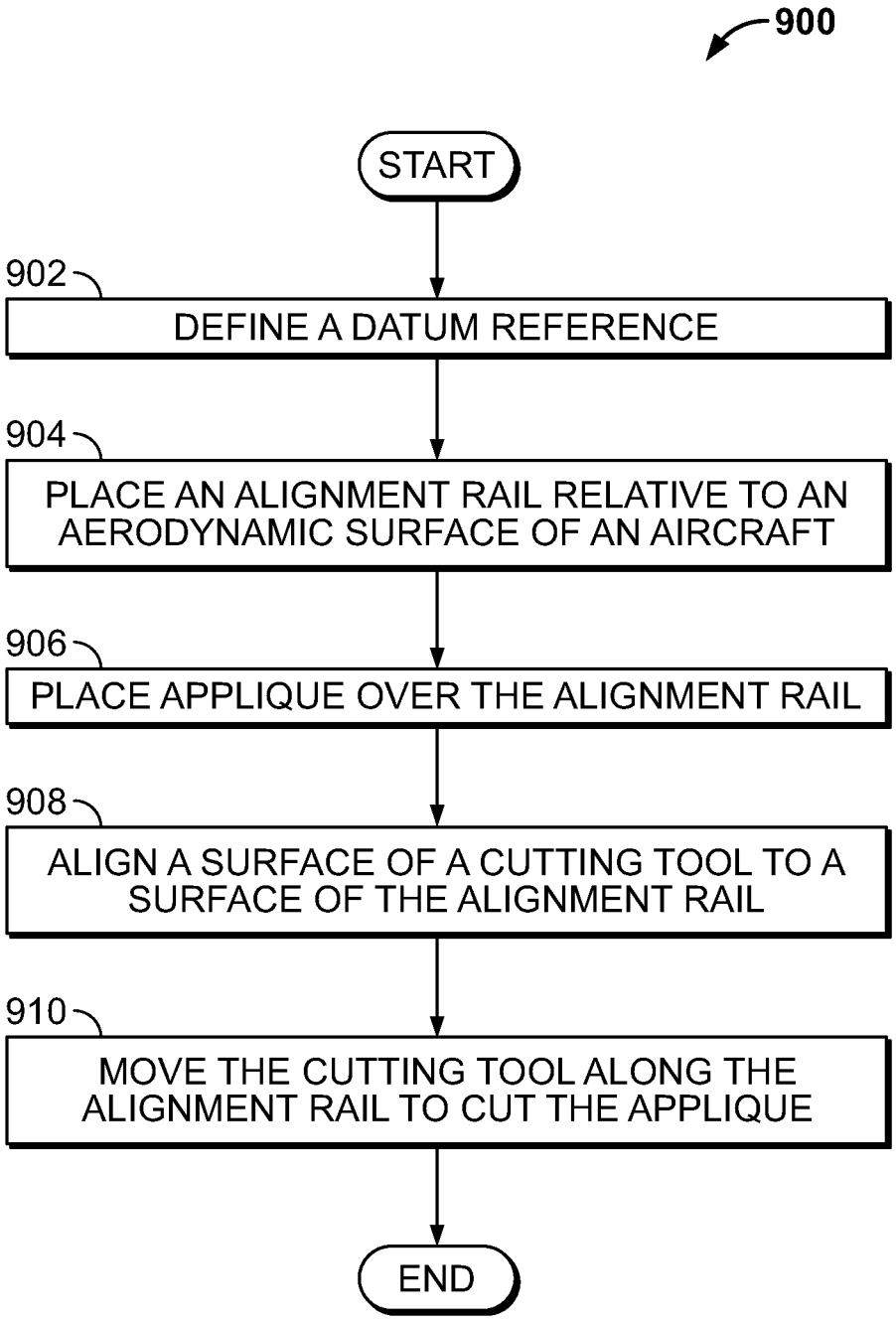
FIG. 9 is a flowchart representative of an example method that may be used to implement examples disclosed herein.

FIG. 9 is a flowchart representative of an example method 900 that may be used to implement examples disclosed herein onto the aircraft 100, for example. The example method 900 of FIG. 9 begins at block 902 where a datum reference is defined. For example, the laser guide 208 is utilized to define a datum reference (e.g., a starting position) to align and/or position the first alignment rail 206.

According to the illustrated example, the first alignment rail 206 is placed relative to the aerodynamic body 202 of the aircraft 100 (block 904). For example, the first alignment rail 206 is placed onto the aerodynamic body 202 of the aircraft 100 based on the datum reference.

Next, the applique 204 is placed over the first alignment rail 206 (block 906). In this example, the applique 204 is placed over (e.g., laid over) the first ramped surface 310 of the first alignment rail 206.

In this example, a surface of the cutting tool 500 is aligned to a surface of the first alignment rail 206 (block 908). For example, the channel 512 (e.g., defined by the first ramped surface 506 and the second ramped surface 508) of the cutting tool 500 is aligned with respective surfaces and/or contours of the first alignment rail 206. In particular, the cutting tool 500 is aligned with the first alignment rail 206 due to the groove 326 receiving the ball bearings 516 of the cutting tool 500.

Subsequently, the cutting tool 500 is moved along the first alignment rail 206 to cut the applique 204 (block 910). For example, the cutting tool 500 is moved along the longitudinal length of the first alignment rail 206 to cut the applique 204 and the method 900 ends.

Examples are described below in accordance with teachings of this disclosure. The examples set forth are numbered for clarity. Example 1 includes an alignment rail for use with cutting applique relative to a surface of a vehicle. The example alignment rail includes a base to contact the surface, and a body including a cross-sectional profile extending along a longitudinal axis of the alignment rail. The example alignment rail also includes a groove of the cross-sectional profile extending along the longitudinal axis, where the groove is to align movement of a cutting tool to cut the applique.

Example 2 includes the alignment rail of Example 1, where the cross-sectional profile includes a first ramped surface on a first side of the cross-sectional profile and a second ramped surface on a second side of the cross-sectional profile that is opposite the first side.

Example 3 includes the alignment rail of Example 2, where the first and second ramped surfaces include respective first and second concave surfaces.

Example 4 includes the alignment rail of Example 2, where the first and second ramped surfaces converge toward the groove.

Example 5 includes the alignment rail of Example 4, where the groove is a first groove, and further including a second groove to enable a cutter of the cutting tool to extend therethrough when the applique is positioned over at least one of the first or second ramped surfaces.

Example 6 includes the alignment rail of Example 5, where the second groove is to receive a bearing of the cutting tool.

Example 7 includes the alignment rail of Example 2, where each of the first and second ramped surfaces includes a varying slope along a direction away from the base.

Example 8 includes a method, which includes placing an alignment rail relative to a surface of a vehicle and placing an applique over the alignment rail. The example method also includes aligning a first surface of a cutting tool to a second surface of the alignment rail, and cutting the applique by moving the cutting tool along a longitudinal length of the alignment rail, where the cutting tool is guided by the first surface contacting the second surface.

Example 9 includes the method of Example 8, and further includes aligning the alignment rail based on a datum of the vehicle or a spacer coupled to another alignment rail.

Example 10 includes the method of Example 9, where the datum is defined via a laser guide mounted to the datum.

Example 11 includes the method of Example 8, where placing the applique over the alignment rail includes placing the applique on a ramped surface of the alignment rail.

Example 12 includes the method of Example 11, where the ramped surface includes a concave surface.

Example 13 includes the method of Example 11, where the ramped surface is a first ramped surface and the applique is a first applique, and further including placing a second applique on a second ramped surface of the alignment rail.

Example 14 includes the method of Example 8, where the second surface of the alignment rail at least partially defines a groove extending along the longitudinal length.

Example 15 includes the method of Example 8, where the groove is a first groove, and wherein a cutter of the cutting tool extends into a second groove of the alignment rail as the cutting tool moves along the longitudinal length.

Example 16 includes a system for aligning and cutting applique to be applied to a surface of a vehicle. The example system includes an alignment rail having a groove extending along a longitudinal axis of the alignment rail, and a cutting tool having a portion to be aligned and received by the groove.

Example 17 includes the system of Example 16, where the alignment rail includes a ramped surface to align the applique for cutting.

Example 18 includes the system of Example 17, where the ramped surface is a first ramped surface, and wherein the cutting tool includes a second ramped surface to be placed in contact with the first ramped surface during cutting of the applique.

Example 19 includes the system of Example 16, where the groove is a first groove, and wherein the alignment rail further includes a second groove, the cutting tool including a cutter to be received by the second groove.

Example 20 includes the system of Example 16, where the alignment rail is a first alignment rail and further including a second alignment rail to be spaced apart from the first alignment rail via a spacer, the spacer sized to align the second alignment rail parallel relative to the first alignment rail.

From the foregoing, it will be appreciated that the above disclosed methods, apparatus and systems enable efficient and accurate alignment, cutting, and application of applique to an aircraft and other relatively large surfaces. In particular, examples disclosed herein enable applique to be applied with less time, thereby saving labor and costs typically associated with known applique application techniques.

Although certain example methods, apparatus and systems have been disclosed herein, the scope of coverage of this patent is not limited thereto. On the contrary, this patent covers all methods, apparatus and systems fairly falling within the scope of the claims of this patent. While aircraft are described in the examples disclosed herein, the examples disclosed herein may be applied to vehicles, aerodynamic structures, etc. Further, examples disclosed herein can be used with any type of applied material in any appropriate application.

What is claimed is:

1. An alignment tool for use with cutting an applique relative to a surface of a vehicle, the alignment tool comprising:

a cutting tool having a cutting edge;

an alignment rail, the rail comprising:

a base to contact the surface, the base defining a bottom edge of the alignment rail;

a body including a cross-sectional profile extending along a longitudinal axis of the alignment rail, the cross-sectional profile having a first width at the bottom edge, the cross-sectional profile defining a top edge opposite of the bottom edge, the top edge having a second width smaller than the first width, the cross-sectional profile including first and second ramped surfaces extending between a first end and a second end of the alignment rail, each of the first and second ramped surfaces extending from the bottom edge to the top edge, the first and second ramped surfaces to converge at a flat surface of the top edge;

a first groove positioned on the flat surface of the top edge, the first groove extending along the longitudinal axis, the first groove to align the cutting tool to cut the applique; and a second groove on the first ramped surface, the cutting edge of the cutting tool to extend into the second groove when the applique is positioned over at least one of the first or second ramped surfaces, the first ramped surface having a concave surface that extends from the second groove to the bottom edge.

2. The alignment tool as defined in claim 1, wherein the second ramped surface includes a respective concave surface.

3. The alignment tool as defined in claim 1, wherein the first and second ramped surfaces converge toward the first groove.

4. The alignment tool as defined in claim 1, wherein the first groove is to receive a bearing of the cutting tool.

5. The alignment tool as defined in claim 1, wherein each of the first and second ramped surfaces includes a varying slope contour that extends along a direction away from the base.

6. The alignment tool as defined in claim 1, further including a laser mount to support a laser.

7. The alignment tool as defined in claim 6, further including a target for orienting the body based on an emitted laser beam from the laser.

8. The alignment tool as defined in claim 1, wherein the first groove is centered on the top edge to receive at least a portion of the cutting tool.

9. An alignment tool for use with cutting an applique, the alignment tool comprising:

a cutting tool having a cutting edge;

an alignment rail, the rail comprising:

a body including a cross-sectional profile extending along a longitudinal axis of the alignment rail, the cross-sectional profile having a first width at a bottom edge of the alignment rail, the cross-sectional profile defining a top edge opposite of the bottom edge, the top edge having a second width smaller than the first width;

each of first and second ramped surfaces of the cross-sectional profile extending from the bottom edge to the top edge, the first and second ramped surfaces to converge at a flat surface of the top edge; a first groove positioned on the flat surface, the first groove extending along the longitudinal axis, the first groove to align the cutting tool to cut the applique; and a second groove positioned on the first ramped surface, the cutting edge of the cutting tool to extend into the second groove when the applique is positioned over at least one of the first or second ramped surfaces, the first ramped surface having a concave surface that extends from the second groove to the bottom edge.

10. The alignment tool as defined in claim 9, wherein the first and second ramped surfaces include respective first and second concave surfaces.

11. The alignment tool as defined in claim 9, wherein the first and second ramped surfaces converge toward at least one of the first or second grooves.

12. The alignment tool as defined in claim 9, wherein the first groove is to receive a bearing of the cutting tool.

13. The alignment tool as defined in claim 9, wherein the second groove is to receive a blade of the cutting tool and the first groove is to receive a bearing of the cutting tool.

14. The alignment tool as defined in claim 9, wherein each of the first and second ramped surfaces includes a varying slope contour that extends along a direction away from the bottom edge.

15. The alignment tool as defined in claim 9, wherein the cutter is a first cutter, and further including a third groove on the second ramped surface, a second cutter of the cutting tool to extend into the third groove when the applique is positioned over at least one of the first or second ramped surfaces.

16. The alignment tool as defined in claim 9, wherein the first groove includes a rectangular cross-sectional profile.

17. The alignment tool as defined in claim 15, wherein the third groove includes a rectangular cross-sectional profile.

18. An apparatus comprising:

a cutting tool;

a means for guiding the cutting tool along a longitudinal length thereof, the means for guiding the cutting tool including first and second ramped surfaces that extend from a bottom edge of a cross-sectional profile of the means for guiding the cutting tool and a top edge of the cross-sectional profile, the bottom edge having a first width, the top edge having a second width smaller than the first width, each of the first and second ramped surfaces extending from the bottom edge to the top edge, the first and second ramped surfaces converging at a flat surface of the top edge; and means for receiving at least a portion of the cutting tool, the means for receiving including a first groove and a second groove, the first groove positioned on the flat surface of the top edge, the second groove positioned on the first ramp surface, the second groove and the first groove extending along a longitudinal axis of the apparatus, the first groove to align the cutting tool to cut an applique, a cutter of the cutting tool to extend into the second groove when the applique is positioned over at least one of the first or the second ramped surfaces.

19. The alignment tool as defined in claim 1, wherein a ratio of the second width divided by the first width is equal to a range from approximately 0.17 to 0.29.

20. The alignment tool as defined in claim 1, wherein the second groove extends normal to the first ramped surface.

* * * * *